United States Patent [19]

Tsai

[11] Patent Number: 4,570,750

[45] Date of Patent: Feb. 18, 1986

[54] FIRE ESCAPE

[76] Inventor: Chin-Wang Tsai, P.O. Box 10160, Taipei, Taiwan

[21] Appl. No.: 737,264

[22] Filed: May 23, 1985

[51] Int. Cl.[4] ..... A62B 1/00

[52] U.S. Cl. ..... 182/44; 187/16

[58] Field of Search ..... 182/44, 43, 42, 234, 182/236, 239, 231; 187/16, 38

[56] References Cited

U.S. PATENT DOCUMENTS

| | | | |
|---|---|---|---|
| 306,489 | 10/1884 | Hubbard | 182/43 |
| 412,956 | 10/1889 | Humphrey | 187/16 |
| 751,870 | 2/1904 | Other | 182/44 |
| 771,715 | 10/1904 | Cole | 182/44 |
| 826,702 | 7/1906 | Younkman | 182/44 |
| 1,020,065 | 3/1912 | Welsh | 182/236 |
| 1,084,162 | 1/1914 | Moser | 182/44 |
| 1,164,988 | 12/1915 | Burkhart | 182/44 |
| 1,357,668 | 11/1920 | Zetka et al. | 182/43 |

*Primary Examiner*—Reinaldo P. Machado

[57] ABSTRACT

A fire escape includes a pair of wheels having upper and lower wheels, two looping cables fitted with plurality of transverse rods tensioned by the two wheels and also fitted with plurality of platforms extending from partial transverse rods and a gear box driven by the upper wheel and designed to increase the rotation speed by several gear sets in the gear box wherein the first gear set of the gear box is fixed with a driving disc outside the gear box to be preliminarily slackened the rotation speed by a frictional clamping collar disposed around the inner driving disc and the third gear set of the gear box is fixed with a rotating arm which is pivotedly connected with two crank levers each terminated with a centrifugal block to thereby extend the centrifugal block to frictionally contact the inside wall of a drum casing to further slacken the rotation speed of the upper wheel and slow down the descending speed of platform when loaded by weight for safer escape.

3 Claims, 6 Drawing Figures

FIRE ESCAPE

BACKGROUND OF THE INVENTION

U.S. Pat. No. 826,702 disclosed by G. W. Younkman taught a fire escape, which however has the following defects:

1. During fast descending of platform loaded by someone, the two governor-levers 57 will be raised due to centrifugal force which may need a large space to allow their movement. The lever means such as lever 50, rod 48 and arm 46 may also occupy a large space.

2. There are so many pivots or fulcrums provided in Younkman's governing mechanism, which are easily out of order due to poor maintenance since fire escape is not always used and is easily rusty to obstruct the smooth operation of such a governing mechanism.

The present inventor has found these defects and invented the present fire escape.

SUMMARY OF THE INVENTION

The object of the present invention is to provide a fire escape including a wheel unit, a descending means, a gear box, a frictional braking means and a centrifugal braking means in that the frictional braking means operates to preliminarily slacken the descending speed when someone stepping down the platform of the descending means and the centrifugal braking means plays a secondary governing effect to further reduce the suddenly increased speed of the descending body on the platform to absolutely secure the human safety in a fire accident.

DETAILED DESCRIPTION

Figure 1:
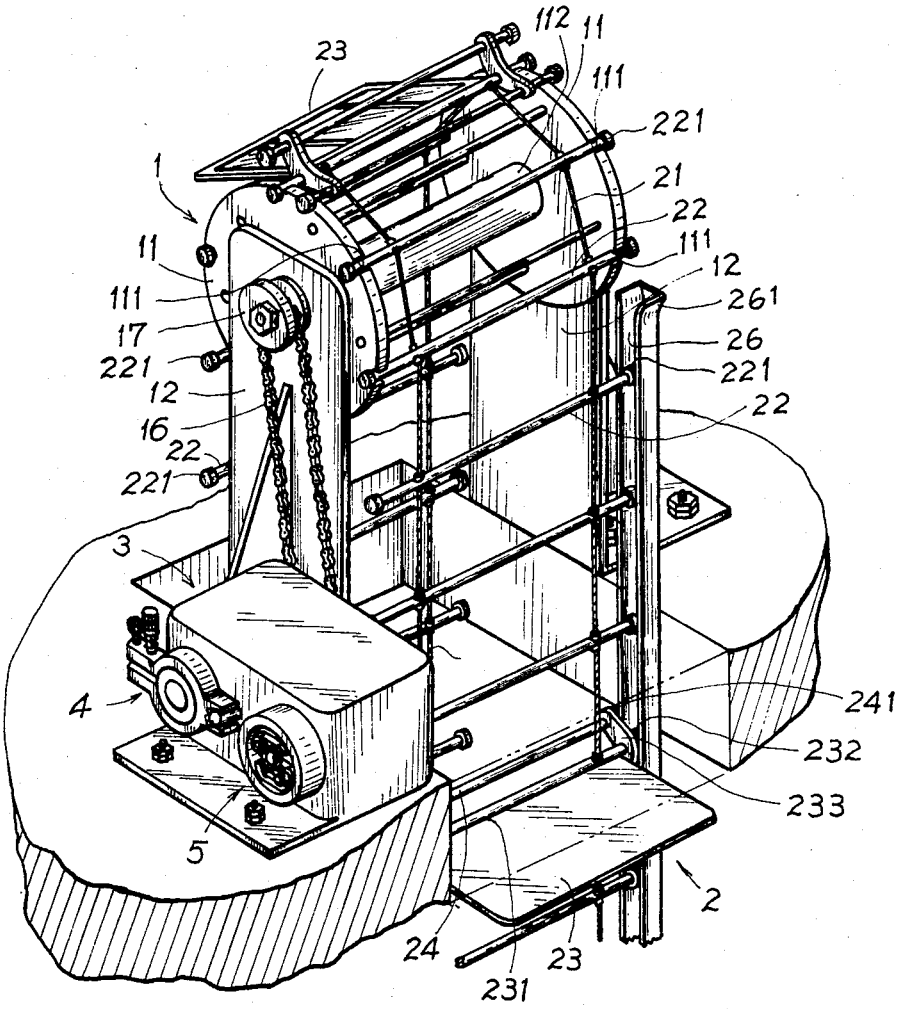
FIG. 1 is a partial perspective drawing of the present invention.

As shown in the figures, the present invention comprises a wheel unit 1, a descending means 2, a gear box 3, a frictional braking means 4 and a centrifugal braking means 5.

The wheel unit 1 comprises an upper wheel 11 mounted on the top floor B of a building A and a lower wheel 13 mounted on the bottom floor C. The upper wheel 11 is rotatably mounted on the floor by pivotting its shaft 112 on two brackets 12. Each upper wheel 11 is formed with a plurality of equally-spaced recesses 111 on its perimeter. The lower wheel 13 is also formed with a plurality of recesses 131 on its perimeter corresponding to the recesses 111 formed on upper wheel 11. The lower wheel 13 is rotatably mounted on the bottom floor C by pivotting the shaft 132 on the two brackets 14. A vertical adjustment device 15 is provided on the lower wheel 13 to adjust the tightness of the cables 21 defined by the two wheels 11, 13.

The descending means 2 comprises: two looping cables 21, a plurality of transverse rods 22 each transversely fitted on the two looping cables 21 and distributed on the cables 21 with equal space between every two rods 22, a plurality of platforms 23 extendibly formed on partial transverse rods 22 and averagedly distributed on the cables 21, and two guides 26 vertically fitted on the passage D of the building A. Each transverse rod 22 is movably engaged with either recess 111 or recess 131 respectively formed on the upper wheel 11 and lower wheel 13. Two rollers 221 are foremd on the two opposite ends of each rod 22 and are slidingly moved within the groove of guide 26. The extremity end 261 of each guide 26 is formed as a trumpet shape for easy pick-up of rod 22 into the guide groove. The platform 23 has its inner edge 231 fixed on the rod 22 and has two rollers 232 slidingly moved within the guide groove. Two brackets 233 are formed on two opposite sides of the rod 22 fixed with platform 23. An upper rod 24 having two end-rollers 241 is formed on the top portion of two brackets 233 to allow two rollers 241 slidingly backing against the rear walls of guides 26. A lower rod 25 having two end-rollers 251 slidingly moved within the guide groove is formed on the lower portion of two brackets 233. The brackets 233 with the rollers will help stabilize the descending of platform when loaded by someone in a fire accident. The guide 26 is fitted to smoothly pick up the incoming rods 22 movably engaged with the recesses 111 of upper wheel 11.

Gear box 3 comprises a casing 31, a first gear set 32, a second gear set 33 engaged with first gear set 32, a third gear set 34 engaged with second gear set 33 and a follower sprocket 35 extending from the shaft 321 of first gear set 32. The sprocket 35 is driven by the driving sprocket 17 extending from the shaft 112 of upper wheel 11 by a chain 16. Such gear sets 32, 33, 34 serve to increase the rotation speed from the driving speed of upper wheel 11 when rotated by weight loaded on the platform 23.

Frictional braking means 4 comprises a driving disc 41 fixed on the shaft 321 of first gear set 32 and a frictional clamping collar 42 disposed around the disc 41. The inside perimeter 420 of collar 42 is frictionally matching with outside perimeter of driving disc 41. Several recesses 421 are formed on the perimeter 420 to prevent biting disc 41 from its rotation. The collar 42 is formed with a pivotting extension 43 which is cut with a pivot hole 431 for pivotting the collar 42 on a pin 45 extending from the casing 31, and is limited on the pin 45 by a retainer 432. The opening end 44 of collar 42 is formed with a lower lug 441 and an upper lug 443 separated by an aperture 411.

A resilient screw 446 is passing through a screw hole 444 formed on the upper lug 443 and fixed into the threaded hole 442 on lower lug 441 by a nut 447. A restoring spring 445 is jacketed on the screw 446 to resiliently clamp the upper lug 443 with the lower lug 441 to tighten the collar 42 on disc 41. An adjusting screw 449 is engaged with a threaded hole 448 formed on the upper lug 443 with its lower screw end riding the lower lug 441. When somebody steps down the platform 23 to rotate the wheel 11 (direction R), the first gear set 32 will be driven to rotate the disc 41 which is frictionally rubbed by the collar 42 to preliminarily reduce the rotation speed of disc 41, gear 32 and wheel 11 so as to safely slacken the descending speed of the falling body.

The centrifugal braking means 5 comprises a drum casing 51 fixed on the casing 31 of gear box 3, a rotating arm 52 fixed on the shaft 341 of the third gear set 34 protruding through an opening 511 on casing 51, two crank levers 53 each having a hole 531 and pivotedly formed on each pivot 521 on two opposite ends of arm 52, two centrifugal blocks 54 each fixed on the end portion of each crank lever 53 and two tension springs 55 each tensioning two crank levers 53 inwards to allow each crank lever 53 being inwards limited by a screw 522 fixed on the arm 52 so as to keep a specific aperture between the block 54 and the inside wall 513 of the cylindrical recess 512 inside the drum casing 51. Each crank lever 53 is limited on the pivot 521 by a retainer 523. Each block 54 is coated with a rubbing pad 541 to increase the frictional braking force when contacting the inside wall 513 of drum casing 51. All arm, levers and blocks are stored in the recess 512.

When the descending speed is suddenly increased due to heavier load on platform 23 even preliminarily slackened by the frictional braking means 4, the speed of third gear set 34 is highly increased as designing the speed ratio of the gear sets 32, 33, 34 to be proportionally increased so that the rotation speed of third gear set 34 and arm 52 is fast enough to exert a centrifugal force to extend the crank levers 53 to allow the centrifugal blocks 54 having rubbing pads 541 frictionally contacting the inside wall 513 of drum casing 51 to further reduce the descending speed of weight loading on platform for absolute safety escape in a fire accident.

Figure 2:
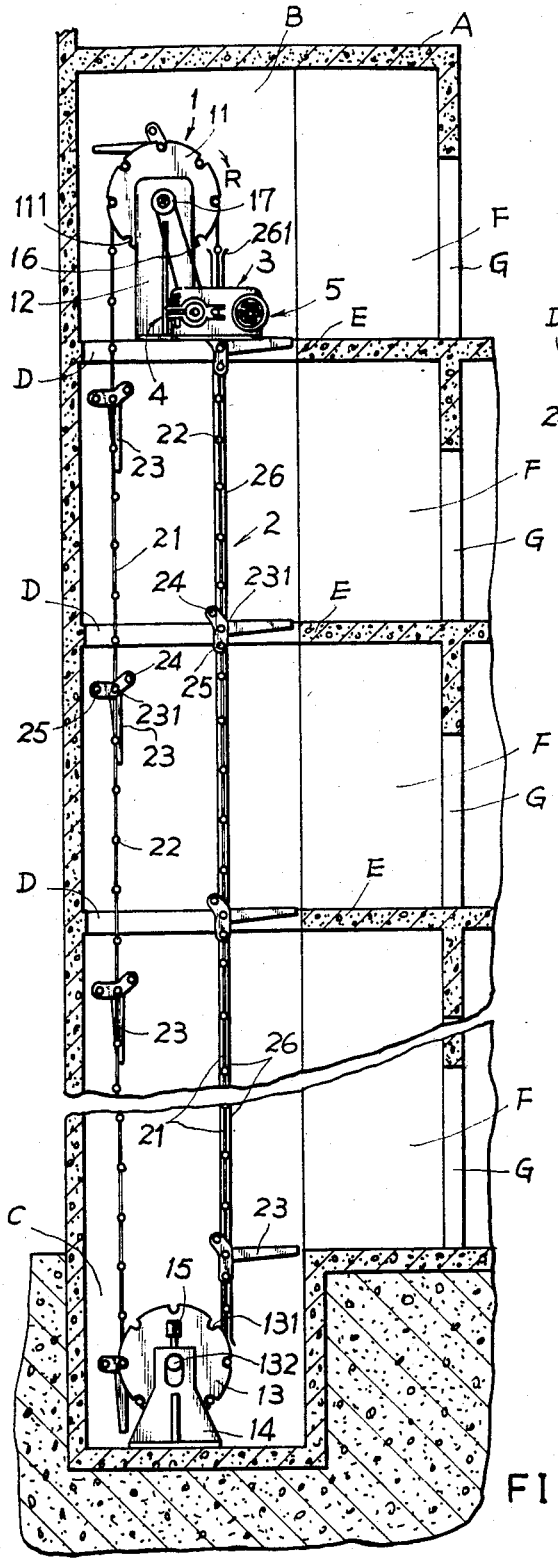
FIG. 2 is a side-elevation illustration of the present invention.
Figure 4:
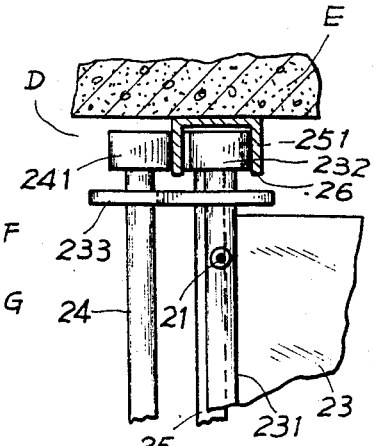
FIG. 4 is a top-view drawing of FIG. 3.
Figure 3:
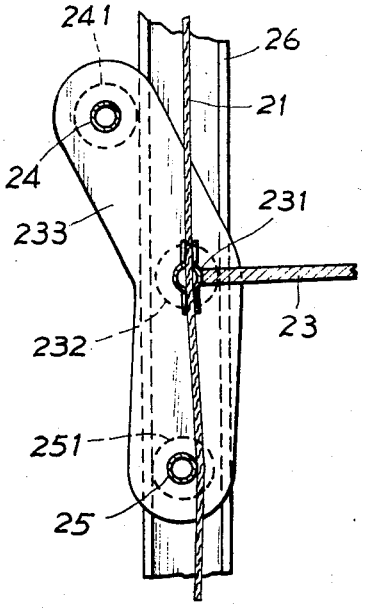
FIG. 3 is a partial illustration of the descending means of the present invention.
Figure 5:
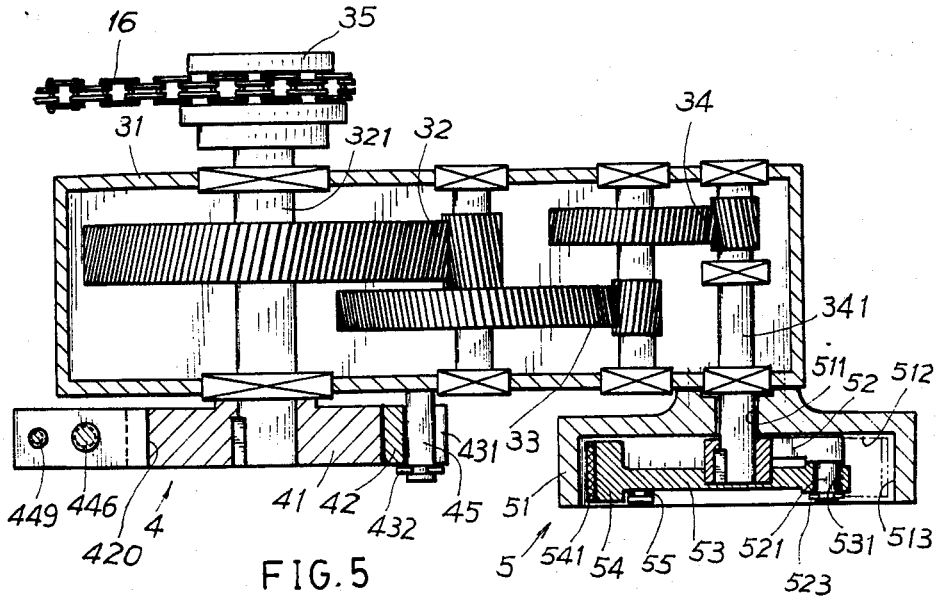
FIG. 5 is a partial top-view illustration of the present invention.
Figure 6:
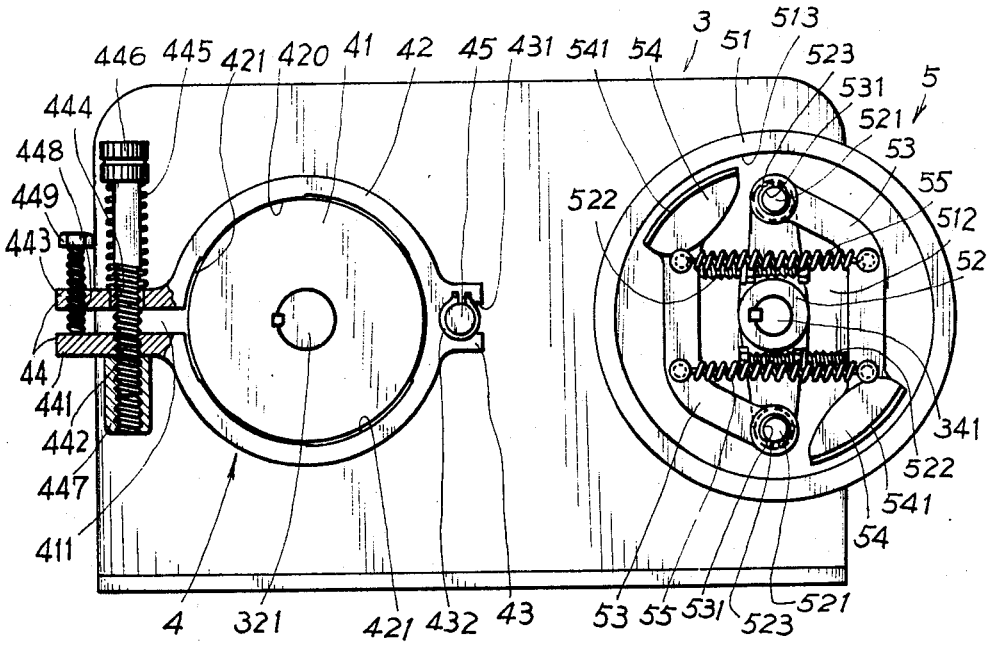
FIG. 6 is a side-view drawing of FIG. 5.

In FIG. 2, a fire-exit room F is provided on each floor E to be pertinent to the passage D of the fire escape of the present invention. Such a room F can be fully insulated to be fire resistant, including the fire door G.

The present invention has the following advantages superior to Younkman's prior art:

1. The frictional braking means 4 and centrifugal braking means 5 are all formed as a compact structure to save the space in a building.

2. The compact structure of such a braking means is easily maintained and can have a longer service life with minimun maintenance problem.

3. The pivots and fulcrums are greatly reduced so as to eliminate the possible rusty and obstructing troubles to be ready for service in a fire accident.

I claim:

1. A fire escape comprising:

a wheel unit having an upper wheel rotatably mounted on the top floor and a lower wheel rotatably mounted on the bottom floor;

a descending means including two looping cables, a plurality of transverse rods each transversely fitting on the two cables and equally spaced on said cables and extending on its both ends with two rollers slidingly moved along the grooves of two guides, a plurality of platforms extending from partial said transverse rods and averagedly distributed on said cables, and two guides fitted on the passage to slidingly move said rollers formed on the two opposite ends of each said transverse rod, said transverse rods being movably engaged with a plurality of recesses formed on the perimeter of either said upper wheel or said lower wheel;

a gear box having a casing, a first gear set driven by said upper wheel by a chain, a second gear set engaged with said first gear set, and a third gear set engaged with said second gear set, said gear sets being proportionally designed to increase their speed ratio so as to greatly increase the rotation speed of said third gear set from said first gear set;

a frictional braking means driven by said first gear set; and a centrifugal braking means driven by said third gear set; the improvement comprising:

said frictional braking means including a driving disc fixed on the shaft of said first gear set and a frictional clamping collar disposed around said disc, said frictional clamping collar having an inside perimeter frictionally matching with the outside perimeter of said driving disc, said collar having an inner extension pivotedly mounted on a pin extending from said casing of said gear box and having an opening end formed with an upper lug and a lower lug spaced with an aperture therebetween, said two lugs being resiliently clamped by a resilient screw jacketed by a restoring spring so as to frictionally tighten said collar around said disc to preliminarily slacken the descending speed of said platform when loaded by weight, said upper lug being fitted with an adjusting screw of which the lower end is riding said lower lug so as to keep a specific aperture between said upper lug and said lower lug; and said centrifugal braking means including a drum casing fixed on said casing of said gear box and formed with a cylindrical recess, a rotating arm fixed on the shaft of said third gear set, two crank levers pivotedly formed on two opposite ends of said arm, two centrifugal block each coated with a rubbing pad formed on the end of each crank lever and two tension springs each tensioning two said crank levers inwards to keep a specific aperture between said block and the inside wall of said cylindrical recess, whereby said rotating arm as driven by said third gear set when sudden increase of descending speed due to heavier weight loading on said platform will be fast rotated to exert a centrifugal force to extend said two levers and centrifugal blocks to frictionally contact the inside wall of said drum casing so as to greatly reduce the rotation speed of said gear sets, said upper wheel and the descending speed of the loaded platform for safer escape in a fire accident.

2. A fire escape according to claim 1, wherein said collar disposed around said driving disc of said frictional braking means is formed with several recesses on the inside perimeter of said collar to prevent biting said disc from obstructing the rotation of said disc within said collar.

3. A fire escape according to claim 1, wherein said rotating arm, said crank levers and said centrifugal blocks are all installed within a cylindrical recess in said drum casing of said centrifugal braking means.

* * * * *